United States Patent [19]

Richards

[11] Patent Number: 4,480,341

[45] **Date of Patent: * Nov. 6, 1984**

[54] PASSIVE DISPENSER

[75] Inventor: Randall G. Richards, Cincinnati, Ohio

[73] Assignee: The Drackett Company, Cincinnati, Ohio

[ * ] Notice: The portion of the term of this patent subsequent to Dec. 13, 2000 has been disclaimed.

[21] Appl. No.: 436,902

[22] Filed: Oct. 27, 1982

Related U.S. Application Data

[63] Continuation-in-part of Ser. No. 346,975, Feb. 8, 1982.

[51] Int. Cl.[3] ..... E03D 9/02

[52] U.S. Cl. ..... 4/228; 222/425

[58] Field of Search ..... 4/227, 228, 222, 225, 4/220; 222/52, 54, 425, 450

[56] References Cited

U.S. PATENT DOCUMENTS

| | | | |
|---|---|---|---|
| 650,161 | 5/1900 | Williams et al. | 4/228 |
| 969,729 | 9/1910 | Smith | 4/228 |
| 991,825 | 5/1911 | Bogie | 4/228 |
| 1,175,032 | 3/1916 | Williams | 4/228 |
| 3,339,801 | 9/1967 | Hronas | 222/57 |
| 3,504,384 | 4/1970 | Radley et al. | 4/228 |
| 3,618,143 | 11/1971 | Hill et al. | 4/228 |
| 3,769,640 | 11/1973 | Castronovo | 4/228 |
| 3,778,849 | 12/1973 | Foley | 4/228 |
| 4,171,546 | 10/1979 | Dirksing | 4/228 |
| 4,186,856 | 2/1980 | Dirksing | 222/424.5 |
| 4,208,747 | 6/1980 | Dirksing | 4/228 |
| 4,216,027 | 8/1980 | Wages | 134/36 |
| 4,251,012 | 2/1981 | Owens et al. | 222/185 |
| 4,281,421 | 8/1981 | Nyquist et al. | 4/228 |
| 4,305,162 | 12/1981 | Cornelisse, Jr. et al. | 4/228 |
| 4,307,474 | 12/1981 | Choy | 4/228 |
| 4,419,771 | 12/1983 | Richards | 4/228 |

FOREIGN PATENT DOCUMENTS

| | | | |
|---|---|---|---|
| 11469 | of 1891 | United Kingdom | 4/228 |
| 3349 | of 1893 | United Kingdom | 4/228 |

*Primary Examiner*—Stephen Marcus
*Attorney, Agent, or Firm*—C. Zeller

[57] ABSTRACT

A passive dispenser adapted for placement in a body of liquid for codispensing a first solution and a second solution in response to a lowering of the level of the body of liquid from a first elevation to a second elevation, the dispenser comprising a first chamber for storing said first solution having an inlet/outlet pathway comprising an interior conduit and an exterior conduit adapted to discharge said solution by siphon flow and further having a vent conduit extending to the atmosphere, and a second chamber for storing said second solution having a refill/discharge pathway comprising a conduit adjacent the chamber and a conduit adjacent the body of liquid and further having venting means, the refill/discharge pathway and venting means being adapted to isolate said second chamber from the body of liquid by means of the formation of air locks.

17 Claims, 15 Drawing Figures

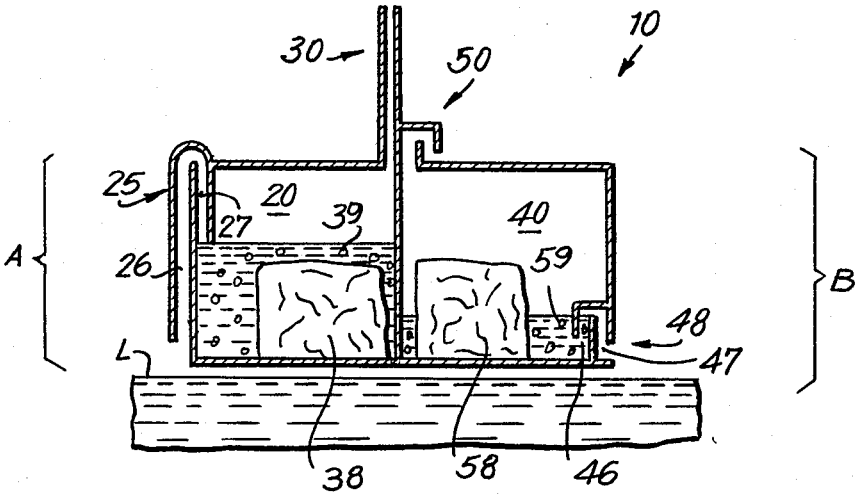
FIG. 8
FIG. 9
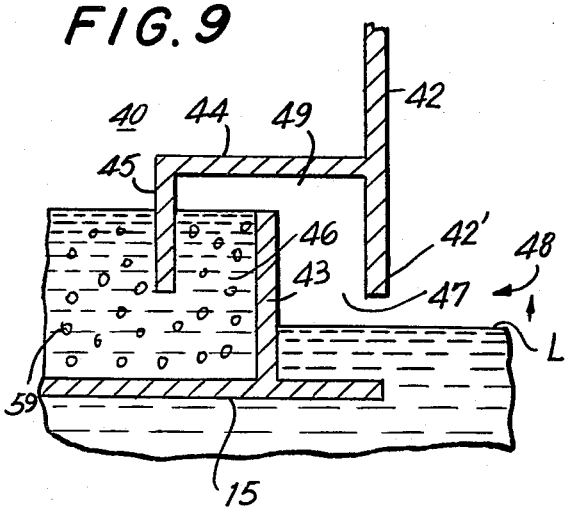
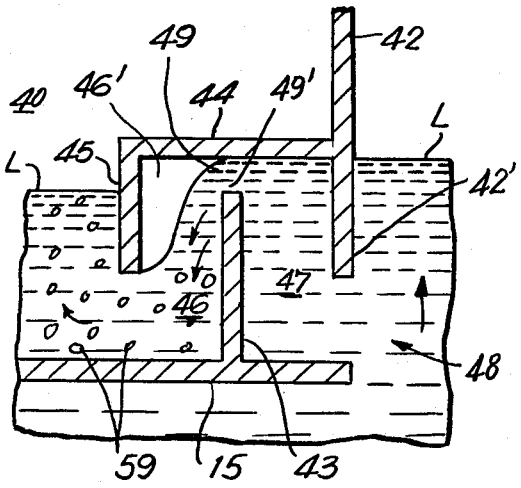
FIG. 11
FIG. 10
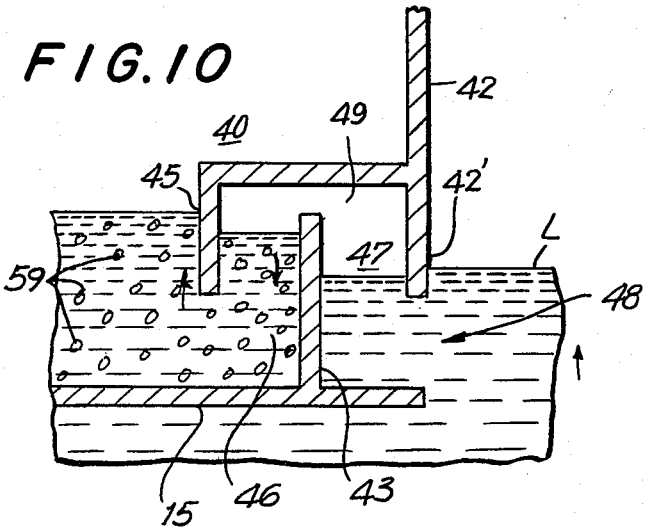

PASSIVE DISPENSER

This is a continuation-in-part of copending U.S. patent application Ser. No. 346,975 filed Feb. 8, 1982.

DESCRIPTION

1. Field of Invention

The present invention relates to a dispenser, adapted for placement in a body of liquid, for dispensing materials, such as toilet tank additives, e.g., disinfectants, detergents, and the like, in solution form from separate product chambers of the dispenser in response to a lowering of the height of the body of liquid. More specifically, the present invention relates to a dispenser comprising two separate product chambers codispensing respective solutions simultaneously, said dispenser having no moving parts. Most specifically, the present invention relates to a dispenser for materials in solution form, one chamber of said dispenser isolating its solution from the body of liquid by means of air locks during quiescent periods, e.g., periods between flushes.

2. BACKGROUND OF THE INVENTION

Numerous devices for dispensing a cleaning or disinfectant solution into a toilet tank for flow into the toilet bowl when the tank is flushed are known. These devices can be characterized as active dispensers, wherein valves or other mechanisms are used to initiate flow from the dispenser when the toilet tank is emptied to a given level, or as passive dispensers, wherein no moving parts are employed, the flow of a predetermined amount of solution from the dispenser being actuated solely by a lowering of the height of the water contained in the tank. Exemplary of the former class, i.e., active dispensers, are devices described in U.S. Pat. No. 1,307,535 to Ciancaglini; 2,692,165 to Sinkwich; 3,341,074 to Pannutti; 3,698,021 to Mack, et al; 3,778,849 to Foley; 4,036,407 to Slone, and 4,244,062 to Corsette. A disadvantage of these active-type dispensers is a tendency for the valve or other mechanical actuating means to become clogged, and thus fail in an open or closed position. Passive-type dispensers overcome this particular problem inasmuch as there are no moving parts that can fail to operate in the proper manner.

In one type of such passive dispensers, the dispenser is alternatively flooded when the tank is filled and emptied (at least partially) by siphoning solution therefrom when the tank is flushed. See, for example, U.S. Pat. Nos. 650,161 to Williams, et al; 969,729 to Smith; 1,144,525 to Blake; 1,175,032 to Williams; 1,213,978 to Thornton; 1,987,689 to Lewis, and 3,339,801 to Hronas. In another type of passive dispenser, the dispensing device is alternately flooded and drained gravitationally, as illustrated in U.S. Pat. No. 991,825 to Bogie; 3,121,236 to Yadro, et al; 3,423,182 to Klasky; 3,504,384 to Radley, et al; 3,545,014 to Davis; 3,604,020 to Moisa; 3,618,143 to Hill, et al; 3,769,640 to Castronovo; 3,772,715 to Nigro; 3,781,926 to Levey; 3,867,101 to Herring; 3,943,582 to Daeninckx, et al, and 3,952,339 to Baur, et al.

U.S. Pat. Nos. 2,688,754 to Willits, et al; 3,073,488 to Komter; 3,784,058 to Buchtel; 3,864,763 to Spransy; 3,895,739 to Buchtel, and 3,965,497 to Corsette and U.K. Patent No. 705,904 disclose toilet chemical dispensers wherein the head of liquid solution within the container forces solution therefrom when the tank water level falls below the spout of the dispenser. Filling of the tank above the discharge spout prevents solution from leaving the dispenser. In a further type of passive dispenser, the solution to be dispensed is connected to a pressurized water supply such as the trap refill pipe in a toilet tank. See, for example, U.S. Pat. Nos. 3,407,412 and 3,444,566 to Spear, wherein the direction of flow alternates in labyrinth passages.

In each of the above-mentioned passive dispensers, in view of the construction thereof, the solution within the dispenser can migrate or diffuse into the toilet tank water during quiescent periods.

Passive dispensers using air locks, i.e., pockets of air to isolate the solution, particularly a disinfectant solution, from the tank water during quiescent periods in a toilet tank have been disclosed, as indicated in the table of references below: U.S. Pat. Nos. 4,171,546 Dirksing; 4,186,856 Dirksing; 4,208,747 Dirksing; 4,216,027 Wages; 4,251,012 Owens et al.; 4,281,421 Nyquist et al.; 4,305,162 Cornelisse, Jr. et al.; 4,307,474 Choy.

The '546 patent discloses a passive dispenser which issues a predetermined volume of a toilet tank additive solution into a toilet tank as the water is draining therefrom. According to this patent, an amount of a concentrated additive solution is drawn from a storage compartment into the tank as the water level therein drops. The device is provided with numerous baffles and passageways as to form air locks that isolate the concentrated disinfectant solution from the tank water during quiescent periods of nonuse. In this device, the air locks are located at the top of the device.

The '856 patent discloses a passive dispenser having an air lock formed in the top portion thereof when submerged so as to isolate the tank water from the disinfectant solution contained therein. Another passive dispenser is disclosed in the '747 patent wherein the air locks are disposed at different levels, whereas those employed in the '546 and '856 patents are at one level in the top portion of the dispenser. The '747 patent employs a siphon tube for dispensing liquid from the dispenser, said siphon tube having passive means to effect the formation of an air bubble subsequently repositioned to form an air lock across the discharge flow path.

The '027 patent discloses a two-chamber device for codispensing a surfactant solution and a disinfectant solution, each of said chambers being isolated from the tank water in a manner disclosed by the '546, '856 or '747 patents. In each of the above-mentioned patents employing an air lock, the dispensers have tortuous flow paths of complex construction. There is need, therefore, for a passive dispenser of simple construction adapted for dispensing both a cleaning and dye solution and a disinfectant solution from separate chamber, one chamber of which is isolated to prevent intermingling of the discrete solutions, which solutions might otherwise interact chemically with one another.

SUMMARY OF THE INVENTION

It is an object of the present invention to codispense a first solution and a second solution from a passive dispenser having separate chambers for each solution into a body of liquid, one chamber of said dispenser being isolated from said body of liquid.

It is a further object of the invention is to provide a dispenser containing a surfactant solution and a disinfectant solution in isolation one from the other, said solutions being dispensed into a body of liquid in response to a lowering of the level of said body of liquid from a first elevation to a second elevation.

Another object of the invention is to avoid interaction of said first and second solutions prior to the codispensation of same.

A primary object of the invention is to provide a dispenser suitable for use in a toilet tank, wherein the disinfectant material is contained within the chamber isolated from the tank water, and wherein the surfactant material is contained within the chamber in fluid communication with the tank water, the disinfectant and surfactant materials being within water soluble cakes, bars, or packets within said respective chambers. Upon flushing the respective solutions are codispensed into the tank water, and subsequently into the toilet bowl, the dispenser being suitable to deliver a multiplicity of uses.

These and other objects and advantages of the present invention will be more fully understood upon inspection of the drawings and upon reading of the detailed description, a summary of which follows.

The passive dispenser of the present invention comprises two dispensing sections, the first dispensing section comprising a first chamber for containing a surfactant cleaning solution, and a second dispensing section comprising a second chamber for containing a disinfectant solution. The first chamber is provided with an inlet/outlet pathway, said pathway comprising an exterior conduit and an interior conduit, said conduits joined at the top to provide a fluid communication pathway between the chamber and the body of liquid. The pathway is adapted for siphon discharge of the chamber by having the interior conduit, which extends a predetermined distance into the chamber and below the top wall thereof, terminate above the exterior conduit, which conduit preferably extends to proximate the bottom of the chamber. The first chamber is further provided with a vertical vent conduit that extends from the top of said chamber, and which is in fluid communication with the atmosphere at all times.

The second dispensing section comprises the second chamber which is provided with a refill/discharge pathway comprising an air trap conduit adjacent the chamber and an air refill conduit adjacent the body of liquid, said conduits intersecting at the top to form a transfer port. The second chamber is further provided with venting means in the form of an inverted U, said venting means being located above said refill/discharge pathway and which venting means is submerged when the body of liquid is at the first elevation. Both refill/discharge pathway and venting means are adapted to form an air lock therein, thereby isolating said chamber from the body of liquid. The air lock in the pathway is formed in view of the dimensions of the air trap conduit and the transfer port above said conduit. Hence, the cross-sectional area of the air trap conduit is greater than that of the transfer port, such that air within the pathway is entrapped therein during refill of the chamber, notwithstanding the flow of liquid through the pathway.

BRIEF DESCRIPTION OF THE DRAWINGS

FIGS. 2–8 are simplified cross-sectional views taken along line 2—2 in FIG. 1 showing separate stages of the flush cycle.

FIGS. 9–12 show the levels of liquid in the refill/discharge pathway of section B as the liquid level in the tank rises.

DETAILED DESCRIPTION OF INVENTION

Figure 1:
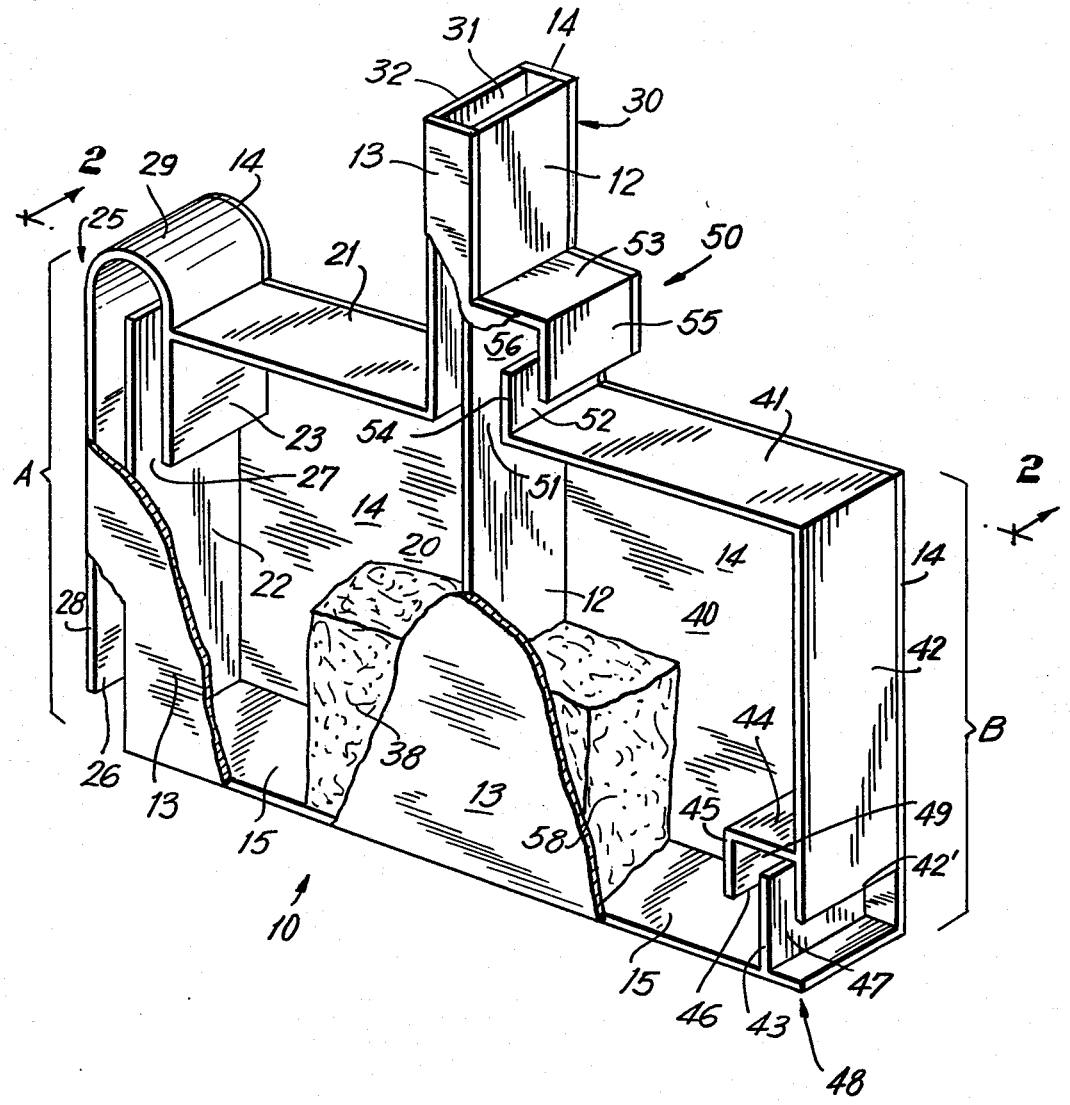
FIG. 1 is a partially cut-away perspective view of the passive dispenser of the present invention.

According to the present invention, there is provided a dual chamber passive dispensing device that codispenses a first solution and a second solution simultaneously into a body of liquid upon a lowering of the level of the body of liquid from a first elevation to a second elevation, said second elevation preferably being below the outlets of each dispensing chamber. The dispenser of the present invention is primarily intended to codispense a surfactant or cleaning solution and a disinfectant solution into a toilet tank upon flushing, these solutions then flowing into the toilet bowl. The chambers are separate one from the other, one such chamber being isolated from the tank water by means of air locks, the other chamber being in fluid communication with the tank water. Because one chamber is isolated, the solutions stored within the dispenser do not come into contact with one another during quiescent periods.

The material contained in the chamber isolated from the tank water is a water-soluble disinfectant containing cake, bar, or packet that forms, upon dissolution, a concentrated disinfectant solution within said chamber, which is available for release into the tank upon a lowering of the tank water level from the first elevation to the second elevation. The non-isolated chamber contains a water-soluble surfactant containing cake, bar, or packet that forms, upon dissolution, a concentrated surfactant solution within said non-isolated chamber, which solution is available for simultaneous release into the tank when the tank level is lowered. Preferably, only a portion of the disinfectant and the surfactant solutions formed within the respective chambers are dispensed each time the tank water level is lowered.

The disinfectant cake comprises a disinfectant agent, for example, a halogen-releasing agent such as an alkali or alkaline earth metal hypochlorite, especially sodium, potassium and calcium hypochlorite. Other disinfectant agents that can be used are, for example, chloramine derivatives, i.e., sodium benezenesulfonchloramine, sodium para-toluenesulfonchloramine, and para-toluenesulfondichloramide; halogenated hydantoins, i.e., 1,3-dichloro-5,5-dimethylhydantoin, 1-bromo-3-chloro-5,5-dimethylhydantoin, and 1,3-dibromo-5,5-dimethylhydantoin; and isocyanurates, i.e., sodium dichloroisocyanurate and trichloroisocyanuric acid. The disinfectant cake can also include other contituents such as binders to provide strength to the cake, both in the dry state to facilitate handling and in the wet state to prevent disintegration; lubricants, and buffering agents. Dyes are specifically not incorporated in the disinfectant cake in view of chemical interaction with the disinfectant agent. Conventional binders, fragrances, lubricants and buffering agents are used.

The disinfectant cake contains an amount of disinfectant that provides a useful dispenser life of from about two to three weeks to about several months, based on normal household use of about 10 to 20 flushes per day. Typically, this criteria suggests a disinfectant cake of from about 15 to 150 grams, the disinfectant therein being at least 30% by weight. The remainder comprises on a weight basis up to 70% binder, less than 15% of the buffering agent, and up to about 5% of the lubricant. The wide variation in cake size and disinfectant amount for the typical disinfectant cake exists in view of different solubilities of the disinfectant agents and in view of the varying bacteriostatic activities thereof.

The surfactant cake comprises a cleaning composition comprising one or more surfactants selected from the group consisting of anionic, nonionic, cationic, and amphoteric surfactants. Other constituents that can be included in the surfactant cake are dyes, fragrances, binders, thickeners, fillers, solubility control agents, and buffering agents. It is preferred that the fragrance and buffering agent be incorporated in the surfactant cake rather than the disinfectant cake. Binders are typically not required in the surfactant cake, the surfactant materials generally forming cakes of suitable dry and wet strength. Conventional binders, fragrances, dyes, lubricants and buffering agents are used.

The anionic surfactants include alkali metal alkyl, alkenyl and alkyaryl sulfate and sulfonate salts of the general formulas $ROSO_3M$ and $RSO_3M$, respectively, wherein R is an alkyl or alkenyl of 8 to 20 carbon atoms, or an alkylaryl group, the alkyl portion of which is a straight or branched aliphatic chain of 9 to 15 carbons, the aryl portion of which is a phenyl, and M is an alkali metal, e.g., sodium, potassium or lithium, or an amine or ammonium. The anionic surfactant may also be an alkali metal salt alkyl phenol ethylene oxide ether sulfate with between 1 to 10 ethylene oxide units per molecule, the alkyl radical containing from 8 to 12 carbon atoms. A preferred anionic surfactant is sodium alpha-olefin sulfonate available as flakes from Lakeway Surfactant under the trade name Siponate 301-10F.

The nonionic surfactant may be an alkylene oxide condensate, an amide or a semi-polar agent. The alkylene oxide condensates include polyethoxylated aliphatic alchols, the alkyl chain having between 8 to 20 about carbon atoms, and the number of ethylene oxide units being between 4 and 12; polyethoxylated alkyl phenols wherein the alkyl group contains between 6 and 12 atoms and the number of ethylene oxide units between 50 to 25; difunctional blocks polymers of polyoxyalkylene derivatives of propylene glycol, and tetrafunctional polyether block polymers of polyoxyalkylene derivatives of ethylenediamine. Amide-type nonionics are the ammonia and ethanolamides of fatty acids whose acyl portion contains from 8 to 18 carbon atoms while the semi-polar type nonionics are the amine oxides, phosphine oxides and sulfoxides. Preferred nonionics are condensates of ethylene oxide with hydrophobic bases formed by condensing propylene oxide with propylene glycol. Exemplary of this surfactant group are the surfactants sold under the trademark Pluronic by BASF Wyandotte, e.g., Pluronic F-108 and Pluronic F-127. Also preferred are tridecyl- and decyloxypoly(ethyleneoxy) ethanols sold under the trade name Emulphogene by GAF Corporation, e.g., Emulphogene TB-970, a tridecyloxypoly(ethyleneoxy) ethanol in flake form.

Cationic surfactants can be incorporated into the surfactant cake. Because cationic surfactants are typically incompatible with anionic surfactants, the use of cationics is generally limited to anionic free cakes, wherein the cationic surfactant is incorporated to provide germicidal activity or to regulate the surfactant solution properties. Exemplary of cationic surfactants suitable herein are alkyl dimethyl benzyl ammonium chlorides, i.e., Ammonyx T and BTC 1326 sold by Onyx Chemical Company; ammonium chlorides, i.e., BTC-1100R sold by Onyx Chemical Company and the Triton RW-Series surfactants sold by Rohm and Haas Company, which have the chemical formula $RNH(OCH_2CH_2)_n OH$ wherein n=1 to 15.

Suitable amphoteric surfactants include betaine derivatives, e.g., coco betaines such as Ampho B11-34 sold by Capital City Products, cocoamidopropyl betaine such as Cycloteric BET C-30 sold by Cyclo Chemicals; imidazolines, e.g., lauric-based imidazoline amphoteric, monocarboxylic sold by Quad Chemicals under the trade name Carsonam L; and the diethanolamine and sodium salts of dicarboxylic tall oil and coconut oil derivates, e.g., Miranol C 2M sold by Miranol Chemical Co. The amphoteric surfactants are preferably used in combination with the anionic or nonionic surfactants and are incorporated within the cake to regulate foaming and other properties of the surfactant solution.

The surfactant cakes contains an amount of surfactant that provides cleaning over the useful life of the dispenser, as noted above with respect to the disinfectant cake. A typical surfactant cake ranges from 20 to about 150 grams, the surfactant therein being at least about 30% by weight. Preferably dye and fragrance are incorporated into the surfactant cake, each being present in amounts of between 2 to 15% of the cake by weight. The amount of dye and fragrance incorporated within the cake is, of course, dependent upon the efficacy of the agent selected, and should be sufficient to provide activity for the useful life of the dispenser. A particularly preferred dye is FD&C Blue No. 1, C.I. No. 42,090. Preferably, the surfactant cake is a combination of several surfactants, thereby regulating the dissolution characteristics of the cake as well as the physical properties of the surfactant solution. A preferred surfactant cake comprises on a weight basis between about 15 to 50% Pluronic nonionic surfactant, between about 10 to 40% Emulphogene nonionic surfactant, about 10 to 40% alpha olefin sulfonate anionic surfactant, between about 5 to 12% dye, and from 5 to 12% fragrance.

The disinfectant cake is contained within the isolated chamber to prevent leakage of the disinfectant, an oxidizing agent, into the tank water. If not isolated, high concentrations of disinfectant might otherwise occur in the tank water during extended periods of nonuse. This is especially true where the disinfectant contained within the cake has a high affinity for water, and would therefore tend to diffuse rapidly into the tank water. Hence, by maintaining the disinfectant isolated from the tank water during quiescent periods, disinfectant is depleted during the dispensing operations only. A further advantage is that the disinfectant agent does not interact with the dye (and other chemicals) in the surfactant cake. On the other hand, the wide choice in surfactants provides flexibility in formulating a surfactant cake whose surfactant solution does not leak or diffuse appreciably (i.e., a concentration of surfactant in the toilet tank of more than 10 ppm after a one day period of nonuse).

Although the present invention has been characterized in terms of a toilet tank cleaning and disinfectant dispenser wherein a surfactant solution is dispensed from the non-isolated chamber, and wherein a disinfectant solution is dispensed from the isolated chamber, it is understood and should be appreciated that the claimed dispenser is suitable to dispense any two solutions in a variety of operating environments, and hence, is not limited to dispensing into toilet tanks solely.

FIG. 1 is a perspective view of the dispenser 10 of the present invention, the front side wall of which is partially broken away to reveal the interior features of the dispenser. The dispenser 10 has two dispensing sections A and B, said sections being separated by common partition 12 of the dispenser 10. Front wall 13, back wall 14, and bottom wall 15 of the dispenser 10 are also common to each section A and B.

Dispensing section A comprises a product chamber 20 defined by partition 12, front wall 13, back wall 14, bottom wall 15, top wall 21, side wall 22 extending upwardly from bottom wall 15, and side partition 23 extending downwardly from top wall 21; an inlet/outlet pathway 25 having exterior conduit or leg 26 and interior conduit or leg 27, the pathway 25 being defined by front wall 13, back wall 14, side wall 22, partition 23, side wall 28, and arcuate wall member 29, and a vent conduit 30 having outlet port 31 in the top thereof, said vent extending upwardly from the top wall 21 to the atmosphere and being defined by common wall 12, front wall 13, back wall 14, and side wall section 32 opposite wall 12. The interior conduit 27 of the pathway 25 extends a finite distance below the top wall 21 of section A to define the volume of solution in chamber 20 that is ultimately dispensed, as is hereinafter described in greater detail. Material to be dispensed, represented by a solid surfactant bar or cake 38, is disposed in chamber 20 of dispensing section A, the bar having such dimensions as not to occupy the entire interior space of said chamber 20.

Dispensing section B comprises a product chamber 40 defined by partition 12, front wall 13, back wall 14, bottom wall 15, top wall section 41, side wall 42, partition 43 extending upwardly from bottom wall 15, horizontal partition 44 extending into the chamber 40 from wall 42, and partition 45 extending downwardly from partition 44; a refill/discharge pathway 48 defined by partitions 43, 44, and 45 and side wall segment 42' and comprising an air trap conduit 46 adjacent the chamber 40 and an air refill conduit 47 adjacent the body of liquid, said conduits being in fluid communication at their uppermost portion beneath horizontal partition 44, the space formed by the intersection of the conduits 46, 47 being designated as the transfer port 49; and an inverted U shaped venting means 50 having an interior conduit 51 and an exterior conduit 52, said venting means 50 being defined by common wall 12, a partition 53 extending horizontally from wall 12, a partition 54 extending upwardly from top wall section 41, and a partition 55 extending downwardly from partition 53 and exteriorly of partition 54. Material to be dispensed, represented by a solid disinfectant bar or cake 58, is disposed in chamber 40 of dispensing section B, the bar having such dimensions as not to occupy the entire interior space of said chamber 40. As an alternate to the venting means 50 described above for section B, it is within the scope of the invention to vent section B by means of a vent conduit similar to the vent conduit 30 of section A, the section B being isolated by virtue of said vent conduit extending above the first liquid elevation.

In dispensing section A of the dispenser, 10 the inlet/-outlet pathway 25, in combination with atmospheric vent means 30, provides siphon discharge of the solution contained within chamber 20. Hence, exterior leg 26, bounded by side wall 28 and wall 22, extends below the level of the interior leg 27, bounded by wall 22 and partition 23, the legs 26 and 27 being in fluid communication in the space above partition 22. The depth to which the interior leg 27 extends into the product chamber 20 determines the amount of surfactant solution dispensed from section A, air entering conduit 27 breaking the liquid seal and terminating flow therefrom.

Discharge from section B is by gravity flow, flow therefrom ending when the solution level in the chamber 40 is equal to the height of partition 43. Vertical partition 43 extends upwardly between partition 45 and segment 42' so as to provide the transfer port 49 under horizontal partition 44 wherein an air bubble resides during periods of inactivity, i.e., quiescent periods between flushes. For the air bubble to be retained within transfer port 49, it is necessary that the partition 43 extend above the lower edges of the partition 45 and segment 42'.

Vertical partition 55 of venting means 50 projects downwardly at least to the topmost end of partition 54 so that a pocket of air is trapped in the space 56 common to conduits 51 and 52 when the toilet tank water level is above partition 53. To ensure the formation of the air pocket, partition 55 should extend below the topmost end of partition 54. It should be noted that section B of the dispenser 10, including the vent means 50, is completely submerged at the full level of the tank, while section A of the dispenser 10 is not completely submerged, the vent 30 extending above the water in the tank at the full level.

The material to be dispensed from either section A or section B may also exist in forms other than a bar or cake, for example, as a gel or semisolid, as a coating or impregnate with a suitable carrier, or as a pulruvulent within a water-permeable membrane. As indicated above, the product chamber 20 of section A of the dispenser is in fluid communication with the tank water at all times by means of the siphon pathway 25. Conversely, the chamber 40 of section B is, during quiescent periods, isolated from the tank water by means of air locks located in the transfer port 49 and space 56 of refill/discharge pathway 48 and venting means 50, respectively. As discussed above, the cake or bar containing the surfactant cleaning material, i.e., cake 38, is in section A of the dispenser 10, while the cake or bar containing the disinfectant material, i.e., cake 58, is in section B of the dispenser 10, thereby isolating the disinfectant material solution from the tank water. The surfactant solution, comprising one or more surfactants, has viscosity and surface tension properties such that the downward settling of the surfactant is favored rather than upward migration or diffusion of surfactant solute from chamber 20. Viscosity of the concentrated surfactant solution, which varies over the life of the product, is typically from about 50 to about 1,200 cp. at 25° C., preferably from about 100 to about 800 cp., and surface tension is typically from about 30 to about 50 dynes/cm. at 25° C., proximate the bottom of the chamber. In addition, wall 22 provides a physical barrier to migration that effectively prevents the appearance of high surfactant concentrations in the tank, even after an extended period of inactivity.

The disinfectant solution, on the other hand, tends generally to migrate or diffuse easily, and it is primarily for this reason that the disinfectant solution in chamber 40 is isolated from the tank, which is accomplished by the air locks in spaces 49 and 56. As explained hereinbelow, the relationship between cross-sectional areas of conduits 46 and 47, and transfer port 49 is of primary importance in the present invention. Although conduits 46 and 47 are shown in FIG. 1 as having constant cross sections along the longitudinal axis thereof, this is not an essential requirement of the dispenser 10. Finally, while shown in FIG. 1 as being located proximate the bottom wall 15, the pathway 48 can be placed along side wall 42 at any distance above bottom wall 15, or along bottom wall 15, the only requirement being that the pathway 48 be at an elevation below the venting means 50. The height of the pathway 48, more specifically the height of partition 43, determines the amount of solution ultimately dispensed from the product chamber 40 on each flush.

FIGS. 2–8, cross-sectional view taken along line 2—2 in FIG. 1, illustrate sequentially a refill and discharge cycle of the dispenser 10.

Figure 2:
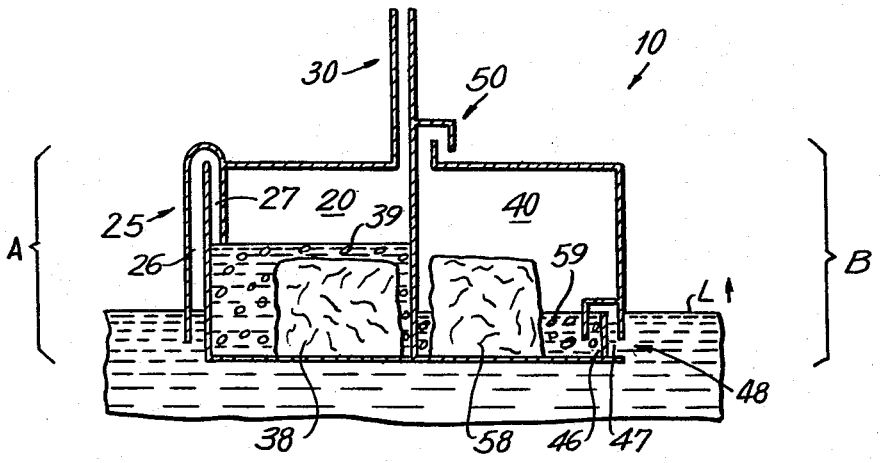
Figure 3:
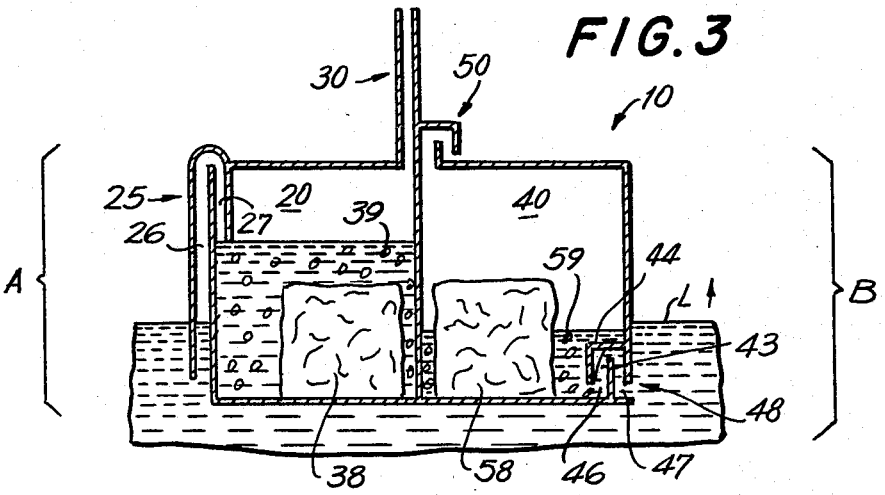

FIG. 2 shows the dispenser 10 in the toilet tank after a flush and as the tank is beginning to refill, water being already present in the lower portions of conduits 26 and 47. Thus, with respect to dispensing section B, an air pocket is shown to be trapped within the pathway 48. Residual amounts of product solutions 39, 59 were retained in the product chambers 20 and 40 after the flush, although the product chambers are dry prior to the initial use of the dispenser 10. In FIG. 3, the water level L in the tank has risen above the level of the horizontal partition 44, and is still within conduit 26 of section A. Because of the difference in hydraulic pressure outside and inside chamber 40, the water flows over partition 43 to initiate filling of chamber 40, an air bubble being retained in air trap conduit 46. As more water enters the toilet tank, water level L continues to rise, with the level in chamber 40 also rising. However, tank water is still within conduit 26, and has not started to enter chamber 20.

Figure 4:
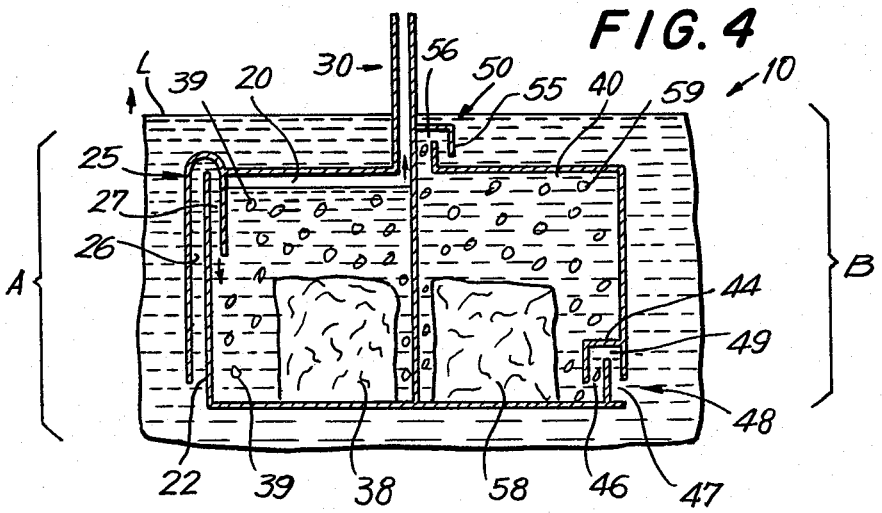
Figure 5:
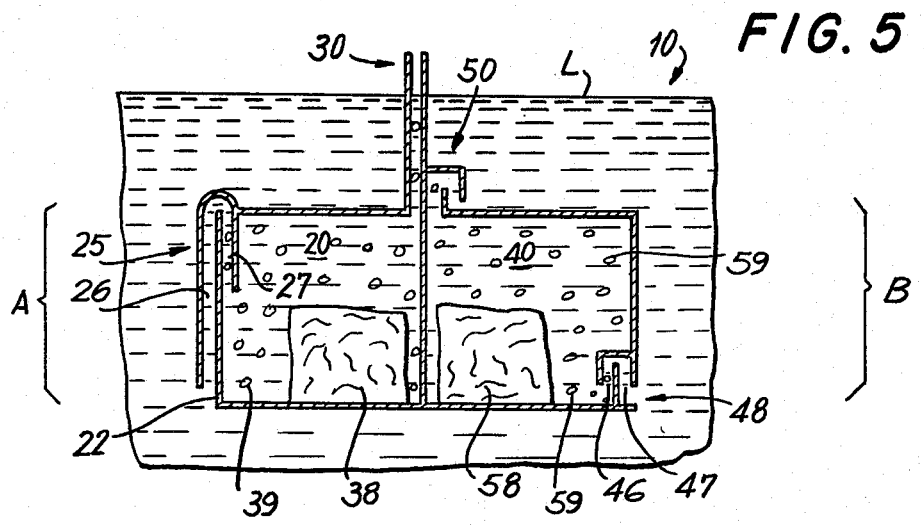

In FIG. 4 the water level L is above the top of wall 22 of section A, and chamber 20 is filling. An air pocket is shown to exist within the transfer port 49 of pathway 48. Further, in FIG. 4, the water level L is above wall segment 55, and a second air pocket has formed in space 56 of the venting means 50 of section B. FIG. 5 shows the dispenser 10 completely immersed in the tank water at the full level, except for vent 30 extending from section A to the atmosphere. Both chambers 20 and 40 are flooded, and the materials therein contain respective solutions 39 and 59. As a result of the presence of air locks in the pathway 48 and the venting means 50, the solution 59 in chamber 40 is isolated from the tank water during quiescent periods between flush and refill cycles. Chamber 20 of section A, however, is not isolated, there being a path of fluid through the pathway 25.

Figure 6:
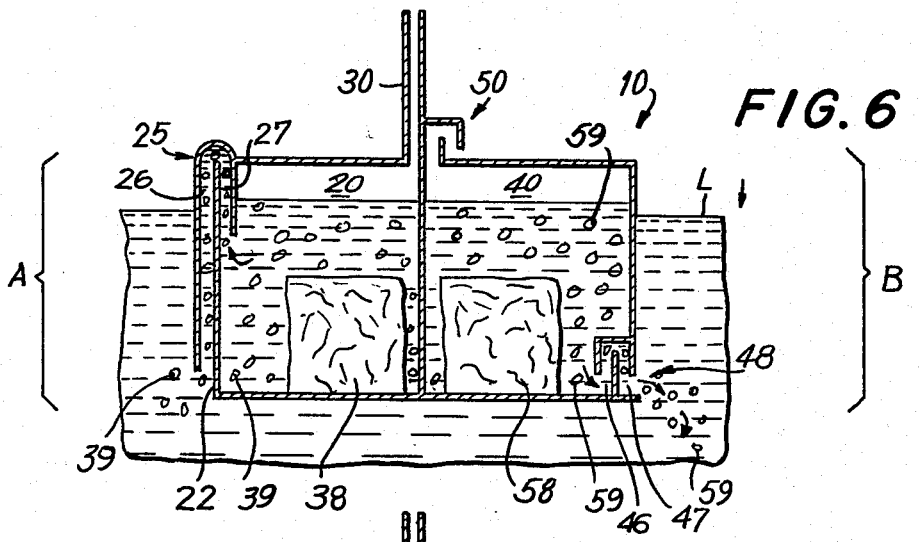
Figure 7:
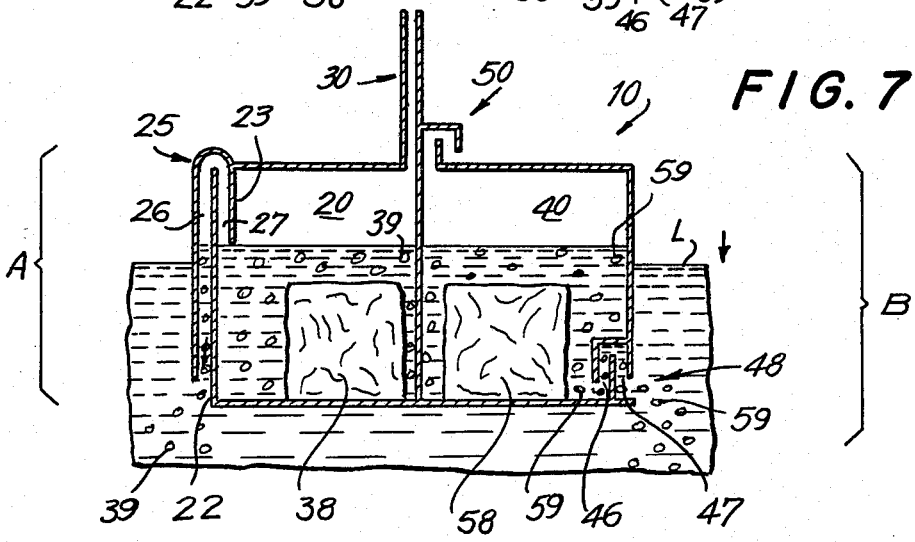

When the toilet bowl is flushed, water level L in the tank drops rapidly, as shown in FIG. 6. The solution 39 in chamber 20 flows into the tank through pathway 25 because of the siphon effect caused by the lowering of the tank water level. The embodiment of the dispenser of FIG. 1 shows the top edge of wall 22 at the same elevation as the top wall 21 of chamber 20. Hence, in this embodiment, all solution flowing from chamber 20 is a result of the siphon effect. However, it is within the scope of the invention to provide a chamber 20 whose top wall 21 is at a lesser or greater elevation than the top of partition 22. In the latter instance flow from the chamber would be both gravitational and siphonic. With respect to section B, FIG. 6 shows that the level in chamber 40 drops by gravity in view of the height of liquid in the chamber above the height of water in the tank. Siphoning action is not involved with respect to section B. When the level of solution 39 in chamber 20 of section A drops to the bottom edge of partition 23, as shown in FIG. 7, air entering conduit 27 breaks the liquid seal, and flow from section A terminates, a residual amount of solution 39 remaining in chamber 20. As shown in FIG. 8, flow from chamber 40 terminates when the level of solution 59 therein is equal to the height of partition 43, a residual amount of solution 59 remaining in chamber 40. When the tank water reaches its lowest level, flow out of the tank into the toilet bowl is cut off and the tank begins to refill, the cycle of FIGS. 2–5 repeating.

With respect to section A, the amount of solution 39 dispensed into the tank is a function of the volume of chamber 20 above the bottom edge of partition 23. The volume of solution 59 dispensed into the tank from chamber 40 is dependent upon the height of partition 43, inasmuch as a siphon is not employed. In addition, for the dispenser 10 shown in FIG. 1, the volume of solution 59 dispensed increases slightly over time as the cake 58 dissolves. Dissolution of cake 38 would affect the amount of solution 39 dispensed from chamber 20 if a portion of the volume of the cake were above the height of partition 23.

The concentrations of the solutions 39 and 59 also vary, and are a function of the volume of water in respective chambers 20 and 40, and the attainment of equilibrium therein. The concentrations can be altered in various ways. For example, a portion of the volume of cakes 38, 58 could comprise insoluble inerts. Two or more additives, each having the same function but with different solubility rates, could be used to extend the useful life of the cakes 38, 50. Similarly, time release of the active constituents could be achieved by encapsulating additives with inert materials. Because a residual volume of solution 39, 59 remains after a flush, the dispensing of at least a dilute solution from each chamber 20, 40 is always assured, as in the case of a second immediate use of the dispenser.

It should be noted that the two sections A and B of dispenser 10 do not necessarily dispense respective solutions at the same rate, and that one chamber may dispense its solution ahead of the other chamber. For example, in FIG. 7 flow of solution 39 terminates when air enters pathway 25, which occurs before the level of solution 59 has reached its lowermost level as determined by the height of partition 43.

Figure 12:
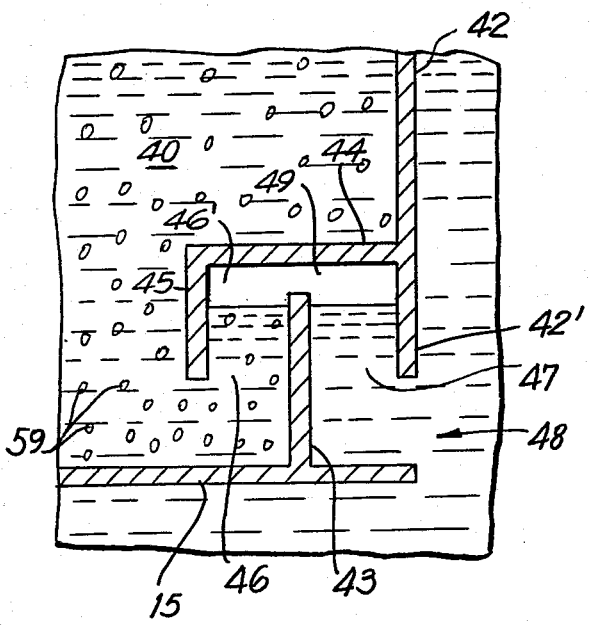

The dimensions for conduits 46, 47 and transfer port 49 are of significant importance in the present invention, as hereinafter described with reference to FIGS. 9–12. FIG. 9 shows water level L rising as the tank is being filled after flushing. In FIG. 10, the water level L in the tank has risen above the lower edge of wall segment 42' causing air within pathway 48 to displace water in air trap conduit 46. As water level L rises still further (FIG. 11), water flows over vertical partition 43 and into air trap conduit 46, as well as chamber 40. In a properly designed pathway 48, a pocket of air 46' is trapped in air trap conduit 46, notwithstanding the filling of the chamber 40 through conduits 46, 47. When the water level rises above the height of the vent means 50, the air pocket 46' transpositions itself over the entire volume of transfer port 49 as depicted in FIG. 12. When the tank is flushed, the water level L drops rapidly, the air pocket 46' now in port 49 having an insufficient volume to prevent flow from the chamber 40 into the tank. As a result, air in port 49 is pushed out through air refill conduit 47 and into the tank followed by the solution 59 in chamber 40.

In order to prevent the air in air trap conduit 46 from being completely displaced into the chamber 40 by water entering the device when the toilet tank is filling, the cross-sectional area of the wall or plane of water in transfer port 49 immediately above the topmost edge of partition 43 (area designated by numeral 49' in FIG. 11) should be appreciably smaller than the cross-sectional area of air trap conduit 46. Where the rate of fill of the toilet tank is such that the entire volume of air refill conduit 47 would be flooded (up to horizontal partition 44), it follows that the cross-sectional area of the wall of water 49' would coincide or essentially coincide with the cross-sectional area of the port 49. By definition, then, in this instance, the transverse cross-sectional area of port 49 should be appreciably smaller than the cross-sectional area of air trap conduit 46. Conversely, should the rate of fill be low, the water would sluice over partition 43. The cross-sectional area of the water 49' would be smaller than the cross-sectional area of the port 49, and port 49 then would not acquire critical dimension limitations. Because, however, the fill rate cannot be forecast a priori except for specific installations, the preferred embodiment has a smaller port 49 cross section than the cross section of the air trap conduit 46. Thus, the preferred dispenser design would, for fill rates typically encountered in conventionally designed tank systems, flood air refill conduit 47. To provide essentially uniform chamber 40 filling, and to further ensure retention of the air pocket, it is preferred that conduits 46, 47 have substantially equal cross-sectional areas. Significantly disparate cross sections are not envisioned, although considerable flexibility exists for proper design. Of course, the aforesaid relationships of port or water wall cross-sectional area to air trap conduit 46 cross-sectional area are overriding. Although it is not critical that the cross-sectional areas of air trap conduit 46 and air refill conduit 47 be constant throughout their respective heights, it is critical, and in keeping with the discussion above, that the cross-sectional area of port 49 or plane 49' be smaller than the largest cross-sectional area of air trap conduit 46.

Figure 13:
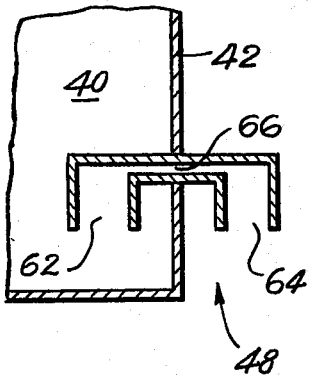
FIGS. 13–15 illustrate cross-sectional views of various configurations of the refill/discharge pathway of section B which can be used in the present invention.

In FIG. 13 the refill/discharge pathway 48 is in the form of an inverted U tube, and disposed in sidewall 42. The pathway comprises two vertical conduits 62, 64 connected at the top portions thereof by a horizontal channel 66.

Figure 14:
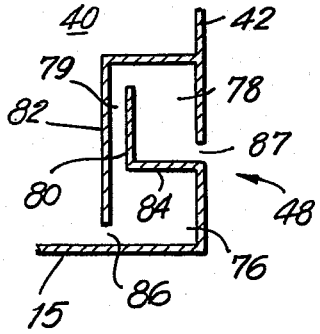

In FIG. 14 pathway 48 is disposed in the lower corner of the dispenser, and comprises two vertical conduits 76, 78 disposed one above the other and being connected by a vertical channel 79 formed by vertical wall segments 80, 82. Conduit 76 is separated from conduit 78 by horizontal wall 84. Sidewall 82 intersects horizontal wall 44 and extends downwardly toward, but does not come into contact with, bottom wall 15 to define opening 86. Conduit 76 is in fluid communication with chamber 40, with conduit 78 and with the tank. Water enters and product solution leaves the dispenser through opening 87.

Figure 15:
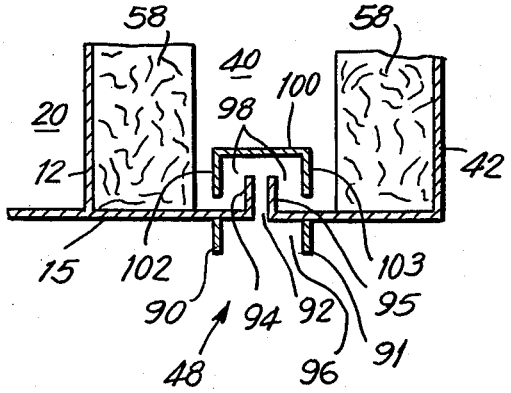

FIG. 15 shows another embodiment of the pathway 48. In this embodiment, conduit 96, bounded by vertical walls 90, 91, projects outwardly from bottom wall 15. Conduit 96 is in fluid communication with conduit 98 by means of channel 92 defined by vertical walls 94, 95 extending upwardly into conduit 98, which is disposed directly above the conduit 96, and which is bounded at the top by horizontal wall 100 and at the sides by vertical walls 102, 103.

In each of the embodiments of FIGS. 13 to 15, the relationships described previously concerning the various cross-sectional areas are applicable. Thus, for example, when the conduit 64 is in flooded condition, the cross-sectional area of channel 66 should be appreciably smaller than the corresponding area of conduit 62, and conduits 62, 64 preferably have substantially the same cross-sectional areas. In view of the designs of the embodiments illustrated in FIGS. 13 and 15, the likelihood of having space cross sections or plane cross sections larger than conduit 62 and 98 cross sections, respectively, is remote inasmuch as the designs virtually assure flooding of the conduits 64, 96.

It is contemplated that the passive dispenser of the present invention will be used by suspending same from the rim of the toilet tank by hanging means. However, other means of placing the dispenser within the tank can be used including, for example, its own weight to maintain the dispenser at the bottom of the tank during use, provided vent 30 extends to the atmosphere.

The passive dispensers of the present invention can be made of any suitable material using known manufacturing techniques. For example, the dispensers can be made by adhesively securing sections of relatively rigid Plexiglas TM (a product of Rohm & Haas Company). As another example, the dispensers may be vacuum thermoformed in two sections of a material such as polyvinyl chloride, the solid, water soluble bar inserted therebetween and, thereafter, the two sections adhered to each other by, e.g., heat sealing. Other polymeric materials which can be used to form the present dispensers include polyethylene, polypropylene, styrene copolymers, acrylics and the like.

I claim:

1. A passive dispenser for containing a quantity of a first solution and a second solution and for codispensing a predetermined volume of said first solution and said second solution into a body of liquid in which the passive dispenser is placed in response to the level of said body of liquid being lowered from a first elevation to a second elevation, the passive dispenser comprising:

a first chamber, said chamber containing a first water-soluble cake forming, upon dissolution, the first solution;

a vent conduit extending from said first product chamber, the top of said vent conduit extending above the first elevation of the body of liquid;

an inlet/outlet pathway, said pathway connecting the first product chamber with the body of liquid and comprising a first conduit exterior the chamber, and a second conduit interior the chamber, said second conduit extending a predetermined distance into the chamber below the top thereof, the bottom of the second conduit being at a greater height than the bottom of the first conduit, said conduit being in fluid communication at their upper ends;

a second product chamber, said chamber containing a second water-soluble cake forming, upon dissolution, the second solution;

venting means extending from the second chamber, said means adopted to isolate the second solution from the body of liquid during quiescent periods, and a refill/discharge pathway disposed below said vending means, said pathway connecting the second product chamber with the body of liquid and comprising two conduits in fluid communication with each other, one conduit being adjacent to said second product chamber to form an air trap conduit, the other conduit being adjacent to said body of liquid to form an air refill conduit, a transfer port connecting said conduits, the air trap chamber being in fluid communicaiton with the second product chamber at a level no higher than the level at which the air refill chamber is in fluid communication with the body of liquid and the cross-sectional area of said transfer port normal to fluid flow being smaller than the cross-sectional area of said air trap conduit normal to fluid flow such that air in said pathway is not completely displaced by said liquid when the level of said body of liquid rises from the second elevation to the first elevation, thereby forming an air lock in said pathway during quiescent periods, whereby, when the body of liquid is lowered from the first elevation to the second elevation, solution in the first product chamber above the bottom end of the interior conduit of the inlet/outlet pathway is dispensed by siphon flow and solution in the second product chamber above the transfer port of the refill/discharge pathway is dispensed by gravity.

2. The dispenser of claim 1 wherein said refill/discharge pathway comprises a pair of vertically disposed conduits in fluid communication with each other only at their uppermost ends to form said transfer port, the conduits constituting the air trap and air refill conduits.

3. The dispenser of claim 1 wherein said refill/discharge pathway comprises a pair of vertical conduits disposed one above the other to form said air trap conduit and said air refill conduit, said transfer port comprising a channel extending from the uppermost portion of said air refill conduit into said air trap conduit.

4. The dispenser of claim 1 wherein said refill/discharge pathway comprises a pair of vertical conduits disposed one above the other to form the air refill conduit and the air trap conduit, said transfer port comprising a channel extending from the uppermost portion of the air trap conduit into the air refill conduit, the upper end of the transfer port being at a level above the opening connecting the air refill conduit with said body of liquid.

5. The dispenser of claim 1 wherein the venting means comprises a conduit extending to the atmosphere.

6. The dispenser of claim 1 wherein the venting means provides fluid communication between the body of liquid and the second chamber, said venting means comprising a pair of vertically disposed conduits in fluid communication with each other only at their uppermost ends whereat an air bubble forms to isolate the second solution from the body of liquid surrounding said dispenser.

7. The dispenser of claim 6 wherein the cross-setional area of the air trap conduit is substantially the same as the cross-sectional area of the air refill conduit.

8. The dispenser of claim 6 wherein the exterior conduit of the first chamber extends downwardly to proximate the bottom of said chamber.

9. The dispenser of claim 6 wherein the first chamber contains a cake containing a surfactant cleansing material and the second chamber contains a cake containing a disinfectant material.

10. The dispenser of claim 9 the surfactant containing cake comprises at least 30% by weight of surfactant selected from the group consisting of anionic, nonionic, cationic, and amphoteric surfactants, and compatible combinations of same, less than 70% by weight binder, between about 0 to 15% by weight dye, between 0 to 15% by weight fragrance, and less than 5% by weight buffering agent, said cake being between about 20 to 150 grams, and whreein the disinfectant cake comprising at least 30% by weight of a disinfectant selected from the group consisting of alkali metal and alkaline earth metal hypochlorides, hydantoins, isocyanurates, and chloramines, less than 70% weight binder, between about 0 to 15% by weight buffering agent, and less than 5% by weight lubricant, said cake being between about 15 to 150 grams.

11. A passive toilet tank cleaner dispenser for containing a quantity of a surfactant solution and a disinfectant solution and for codispensing a predetermined volume of said surfactant and said disinfectant solution into the tank water in which the passive dispenser is placed in response to the water level of said tank being lowered from a first elevation to a second elevation, the passive dispenser comprising:

a first product chamber, said chamber containing a water-soluble surfactant cake forming, upon dissolution, the surfactant solution, said surfactant containing cake comprising at least 30% by weight of surfactant selected from the group consisting of anionic, nonionic, cationic, and amphoteric surfactants, and compatible combinations of same, less than 70% by weight binder, between about 0 to 15% weight dye, between 0 to 15% by weight fragrance, and less than 5% by weight buffering agent, the cake being between about 20 to 150 grams;

a vent conduit extending from said first product chamber, the top of said vent conduit extending above the first elevation of water in the toilet tank;

an inlet/outlet pathway, said pathway connecting the first product chamber with the tank water and comprising a first conduit exterior the chamber, and a second chamber, and a second conduit exterior the chamber, said second conduit extending a predetermined distance into the chamber below the top thereof, the bottom of the second conduit being at a greater height than the bottom of the first conduit, said conduits being in fluid communication at their upper ends;

a second product chamber, said chamber containing the water-soluble disinfectant cake forming, upon dissolution, the disinfectant solution, said disinfectant cake comprising at least 30% by weight of a disinfectant selected from the group consisting of alkali metal and alkaline earth metal hypochlorites, hydantoins, isocyanurates, and chloromines, less than 70% weight binder, between about 0 to 15% weight buffering agent, and less than 5% by weight lubricant, said cake being between 15 to 150 grams;

venting means extending from the second chamber, said means adopted to isolate the disinfecatant solution from the tank water during the quiescent periods, and refill/discharge pathway disposed below said venting means, said pathway connecting the second product chamber with tank water and comprising two conduits in fluid communication with each other, one conduit being adjacent to said second product chamber to form an air trap conduit, the other conduit being adjacent to said tank water to form an air refill conduit, a transfer port connecting said conduits, the air trap chamber being in fluid communication with the second product chamber at a level no higher than the level at which the air refill chamber is in fluid communication with tank water and the cross-sectional area of said transfer port normal to fluid flow being smaller than the cross-sectional area of said air trap conduit normal to fluid flow such that air in said pathway is completely displaced by the tank water liquid when the level of the tank water rises from second elevation to the first elevation, thereby forming an air lock in said pathway during quiescent periods, whereby, when the tank water is lowered from the first elevation to the second elevation, solution in the first product chamber above the bottom end of the interior conduit of the inlet/outlet pathway is dispensed by siphon flow and solution in the second product chamber above the transfer port of the refill/discharge pathway is dispensed by gravity.

12. The dispenser of claim 11 wherein said refill/discharge pathway comprises a pair vertically disposed in fluid communication with each other only at their uppermost ends to form said transfer port, the conduits constituting the air trap and air refill conduits.

13. The dispenser of claim 12 wherein the venting means provides fluid communication between the tank water and the second chamber, said venting means comprising a pair of vertically disposed conduits in fluid communication with each other only at their uppermost ends whereat an air bubble forms to isolate the second solution from the tank water surrounding said dispenser.

14. The dispenser of claim 15 wherein the exterior conduit of the first chamber extends downwardly to proximate the bottom of said chamber.

15. The dispenser of claim 1 or 11 further comprising means to suspend the dispenser in the body of liquid.

16. The dispenser of claims 5, 6, or 13 wherein the air trap conduit is substantially rectangular in configuration, the air being entrapped in a corner of said air trap conduit when the level of the body of liquid rises from the second elevation to the first elevation.

17. The dispenser of claim 16 wherein a quantity solution remains in each product chamber after dispensing of the respective solutions has terminated.

* * * * *